US010189066B1

(12) United States Patent
Garcia

(10) Patent No.: US 10,189,066 B1
(45) Date of Patent: Jan. 29, 2019

(54) WHEEL STRAIGHTENER DEVICE

(71) Applicant: Gahotech Sistemas Automotivos EIRELI—EPP, Ituporanga-SC (BR)

(72) Inventor: Adilson Garcia, Ituporanga (BR)

(73) Assignee: GAHOTECH SISTEMAS AUTOMOTIVOS EIRELI-EPP, Ituporanga-SC (BR)

( * ) Notice: Subject to any disclaimer, the term of this patent is extended or adjusted under 35 U.S.C. 154(b) by 0 days.

(21) Appl. No.: 15/714,389

(22) Filed: Sep. 25, 2017

(51) Int. Cl.

| | |
|---|---|
| ***B21D 41/02*** | (2006.01) |
| ***B21D 3/14*** | (2006.01) |
| ***B21D 3/16*** | (2006.01) |
| ***B21D 53/30*** | (2006.01) |
| ***B21D 1/08*** | (2006.01) |
| ***B21D 1/12*** | (2006.01) |
| ***B21D 1/10*** | (2006.01) |

(52) U.S. Cl.
CPC ..... *B21D 3/14* (2013.01); *B21D 1/08* (2013.01); *B21D 1/10* (2013.01); *B21D 1/12* (2013.01); *B21D 3/16* (2013.01); *B21D 53/30* (2013.01)

(58) Field of Classification Search
CPC ... B21D 1/08; B21D 1/12; B21D 3/14; B21D 1/10; B21D 3/16; B21D 53/30
USPC ..... 72/453.14, 457, 705
See application file for complete search history.

(56) References Cited

U.S. PATENT DOCUMENTS

| | | | | | |
|---|---|---|---|---|---|
| 2,489,815 | A * | 11/1949 | Rader | B21D 1/10 | 157/14 |
| 3,855,831 | A * | 12/1974 | Senkyrik | B21D 1/10 | 72/31.02 |
| 5,303,573 | A * | 4/1994 | Douglas | B21D 1/10 | 269/69 |
| 5,499,524 | A * | 3/1996 | Len | B21D 1/08 | 269/71 |
| 6,367,303 | B1 * | 4/2002 | Hizono | B21D 3/14 | 29/283.5 |
| 7,347,079 | B2 * | 3/2008 | Moreno | B21D 1/08 | 72/311 |
| 7,594,420 | B2 * | 9/2009 | Len | B21D 1/08 | 269/71 |
| 7,921,687 | B2 * | 4/2011 | Stretch | B21D 1/08 | 72/31.02 |
| 2004/0035164 | A1 * | 2/2004 | Blaser, Jr. | B21D 1/12 | 72/31.02 |

* cited by examiner

*Primary Examiner* — David B Jones

(57) ABSTRACT

WHEEL STRAIGHTENER DEVICE describes a constructive configuration in wheel straightener equipment, used for the correction of warped wheel of motor vehicle, in which the modifications applied to the new device relates primarily to the improvement in manufacture and use of such devices, aiming to eliminate the jack and improve wheel support points on the equipment, as well as providing a flange that has a universal feature that meets all 4, 5 and 6-hole models.

14 Claims, 3 Drawing Sheets

WHEEL STRAIGHTENER DEVICE

The subject of the present patent application describes a constructive configuration in wheel-boring equipment used for the correction of warped wheels of automotive vehicles.

Wheel warping in automotive vehicles is a recurring problem and can lead to a variety of other, more serious vehicle problems, including problems such as vibration, loosening of parts, premature wear, discomfort, and poor carriage weight distribution. the wheels, among countless other more serious damages to the vehicle in the future.

In the present state of the art some types of wheel performance devices are known for eliminating problems such as kneading and wheel distortion by applying pressure or impact on the affected region and can cause misalignment, vibrations and other problems that can lead to more serious fractures to other parts of the vehicle.

It can be cited as the previous Brazilian patent document BR102013003510-6 that discloses a machine that works by pressing or pulling only the affected part through two correction tools, tools being said regulated in their positions through axis 4; another document to be quoted is the Brazilian MU8602700-0 which discloses a wheel-type jig-type device having a probe device detecting imperfections in the wheel and in addition to an adjustable arm associated with a hydraulic jack, provides the lever force necessary for the operator to correct the imperfect points of the wheel.

Another important document to be cited is Brazilian patent document MU800166-3. This document reveals an advantage in relation to the documents cited especially regarding the operation of the equipment, since it was developed to work both inside and outside the wheel, in order to facilitate the use of the equipment and to attend with greater efficiency the desired objectives, allowing a correction that provides recovery of the wheel of at least 95% of its original form.

However, this document still has some limitations in its manufacture and use, such as the fact that warpage correction devices usually fasten the wheel through the center and apply pressure at specific points where there were imperfections.

One of the problems identified is the fact of the low productivity due to hydraulic jack operation, which provides the necessary force to press the kneading on the wheel until it is corrected but its operation is slow and causes fatigue to the operator, significantly reducing the productivity in the wheel straightening process.

Another inconvenience has also been identified in the technical precedents, which is the fact of applying force only at one point, the wheel being fixed at the center, that is, applying force at one end, can cause a twist due to bad distribution of forces in the wheel, causing the kneading to be corrected, but causing another type of misalignment in the wheel.

Another detail is that the flange where the fixing of the wheel occurs in the equipment usually comprises a plurality of holes, seeking to meet the widest variety of wheels available on the market with different drilling patterns, however, even with the provision of this plurality of holes there are wheel models that do not fit into any of the available combinations.

Generally the prior art, especially described in patent document MU800166-3, had a constructive form comprising a set containing a wheel attachment column, a support for a hydraulic jack for application of force and correction of imperfection, and a probe template to identify the imperfections contained in the wheel. This system is difficult to operate and can cause damage to the wheel due to its use. Allied to this, the fact of the flange having a plurality of holes that do not meet some models of wheels available in the market.

The modifications applied to the novel device for correcting the warpage of wheels of automotive vehicles mainly refers to the improvement in the manufacture and use of such devices, seeking to eliminate the jack and to improve the issue of the points of support of the wheel in the equipment, as well as to provide a flange that has a universal characteristic, in order to meet all wheel models with the most varied types of drilling available.

In order to increase the practicality of operation and to avoid the occurrence of problems arising from the operation of the aforementioned devices, the object of the present patent application has been developed, consisting of a wheel-making equipment that uses hydraulic piston for application of force at the kneading point, avoiding the user having to intervene constantly, and making the process much faster, and also presents a posterior support, to the point of application of force, making the wheel do not surplus unwanted deformations. Further, the wheel locking flange has a completely different drilling arrangement from those already known in the prior art.

Thus, the patent object consists of a main column, where at its end it has a flange with specific drilling arrangement, for fixing the wheel to be corrected, taking into account the greater variety of wheels available in the market; and at another end has a fixing base for the assembly; in its central portion, said column presents a tubular extension, perpendicular to said column, in which another tubular extension of smaller dimension, forming a telescopic joint, is fitted, at the other end of said tubular extension, means is provided to engage a third segment which is the piston column, wherein said segment positioned perpendicular to the second segment, and parallel to the main column, which provides grooves for height adjustment. This piston column provides means for adjusting height at one end, and at the other end, provides means for the attachment of the hydraulic piston, including anchoring which allows angulation thereof. At the rear of the main column, it provides a support having a suitable shape to support the opposite end of the wheel, to which the force will be applied, i.e., the end opposite the end which is in contact with the piston. By doing this it is possible to meet a large number of wheels available in the market and perform the wheel correction quickly without generating wheel twisting problems.

The constructive configuration of the warpage correction device in automotive vehicle wheels of the present application is better understood from the detailed description set forth below, taken from the attached figure, given by way of example and illustration, and not limiting the scope of the present application.

Figure 1:
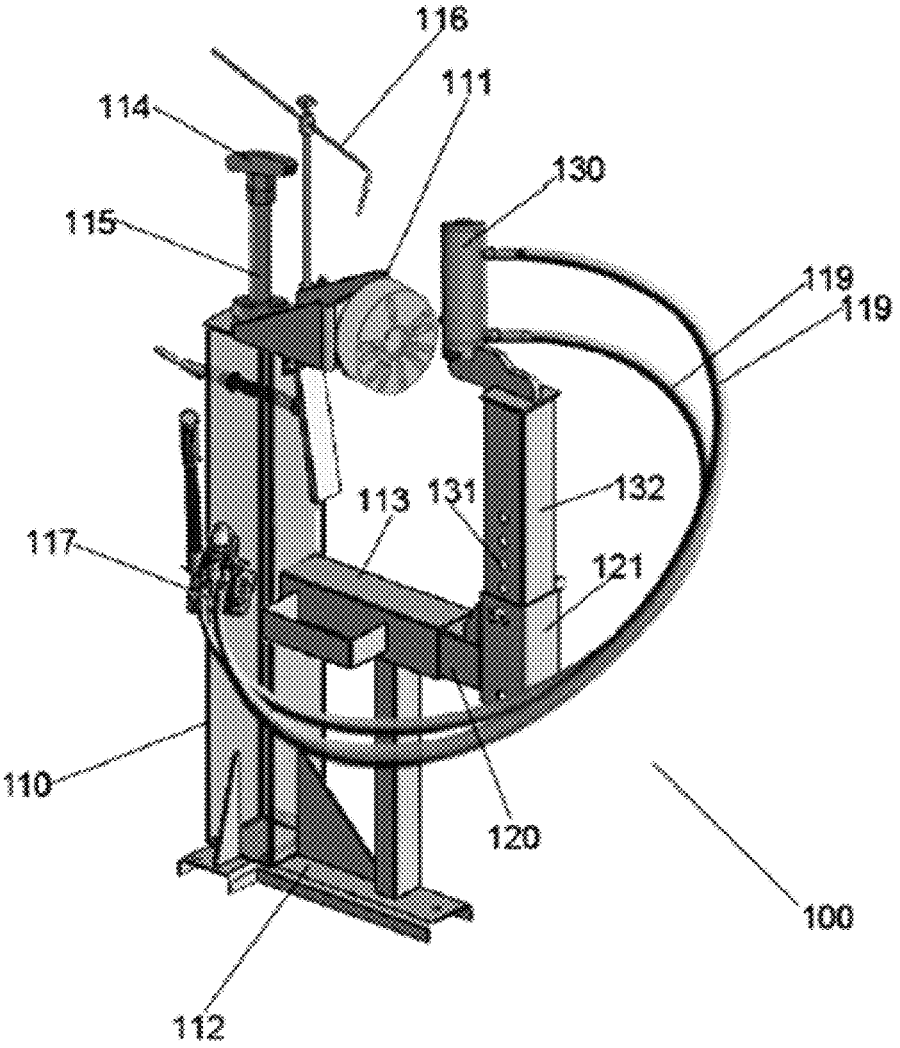
FIG. 1 shows a perspective view of the wheel straightener device (100).

In allusion to the figures shown, said wheel-making device (100), according to FIG. 1, comprises main column (110), wherein at one of its ends, it has a wheel fixing flange (111) to be corrected, and at another end, has a fixing base (112) for the assembly; in its central portion, said main column (110) has a tubular extension (113), perpendicular to said main column (110), where a smaller second tubular extension (120) engages therein, forming a telescopic joint at the other end of said second tubular extension (120), a part (121) is provided to engage a third tube segment, which is the column (132) of the piston (130), which is positioned at the upper end of said column (132).

Said column (132) of the piston (130) is positioned perpendicular to the second extension (120) and parallel to the primary column (110); said column (132) of the piston (130) has means for height adjustment, which can be bores (131) which pins are inserted; and at the other end provides means for the attachment of the hydraulic piston (130), including a type of hinged attachment, so as to allow angulation thereof.

Figure 2:
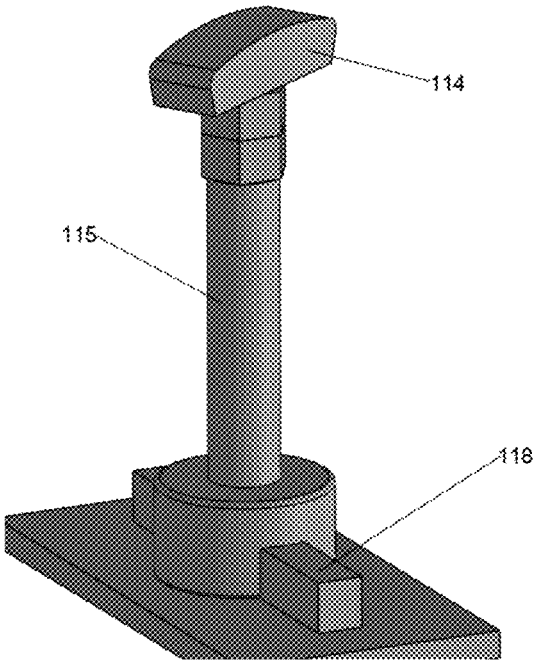
FIG. 2 shows a perspective and detail view of the support (114) of the wheel straightener device (100).

At the top of the main column (110), there is provided a support (114) suitably shaped to support the opposite end of the straightening wheel is desired, i.e., end opposite to that which is in contact with the piston (130); FIG. 2 illustrates the support (114) in detail. Said support (114) is mounted on a body (115), forming a single piece; the support (114) and the body (115) can now be manufactured in a single piece, or may be separate and attachable parts together; in this case the body (115) and the support (114) should provide means to be engaged with each other. Said body (115) may have height adjustment which can be by means of spindle, telescopic or articulated arm; and said body (115) is mounted on a guide (118), wherein both the body (115) and the guide (118) have constructive and socket configuration allowing the displacement of said support (114) on the guide (118) to approach or move away from the positioned wheel on the flange (111); this displacement is necessary for better support of the wheel, of different widths; said body (115) of the support (114) provides means for being locked to the guide (118) after properly positioned; such fixing may be by the body of the spindle itself (115), if their format is a time can be by means of pins and holes, arranged on the body base (115) and the guide (118), or other compatible similar solution. Also, the rear support region (114) is provided for one measuring rod (116) that serves as a template for locating imperfections in the wheel that is to be corrected.

A hydraulic pump (117) is also provided connected by hoses (119) to the hydraulic piston (130), so as to drive said piston (130), said pump (117) is preferably laid out in the central region on the side of the main column (110), and thus provides a more ergonomic position for the operator to operate manually.

Figure 3A:
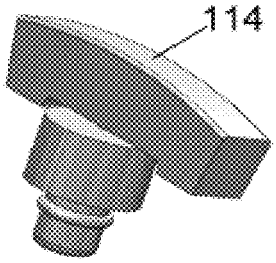
FIGS. 3A, 3B, 3C show possible embodiments for the backrest (114) of the wheel straightener device (100).
Figure 3B:
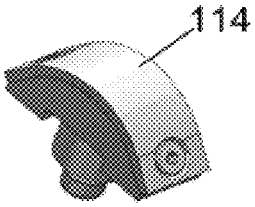
Figure 3C:
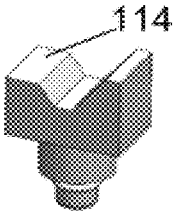

FIGS. 3A, 3B and 3C illustrate different geometric shapes of supports (114), which can be useful to support different wheel shapes such as a flattened formed (FIG. 3A) or a more concave shape (FIG. 3B), or with chamfer recess (FIG. 3C). Other different formats may be possible for this support (114).

Figure 4:
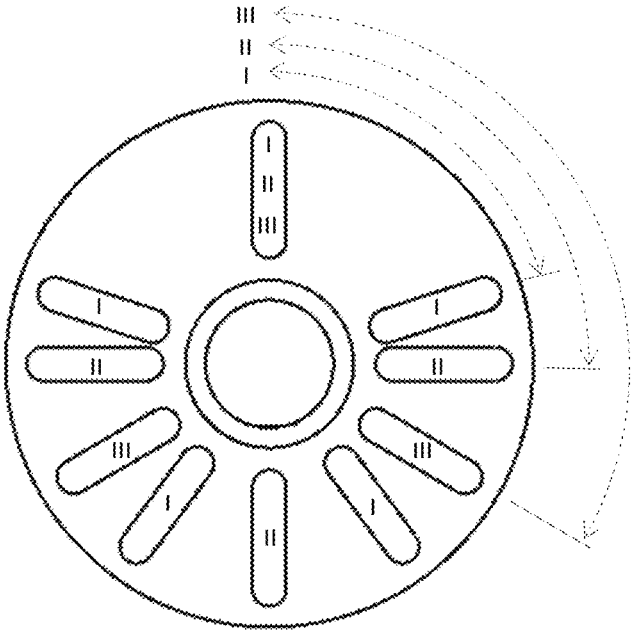
FIGS. 4 and 5 show the constructive arrangement of the flange, part of the equipment where the wheel to be straightened fixed.
Figure 5:
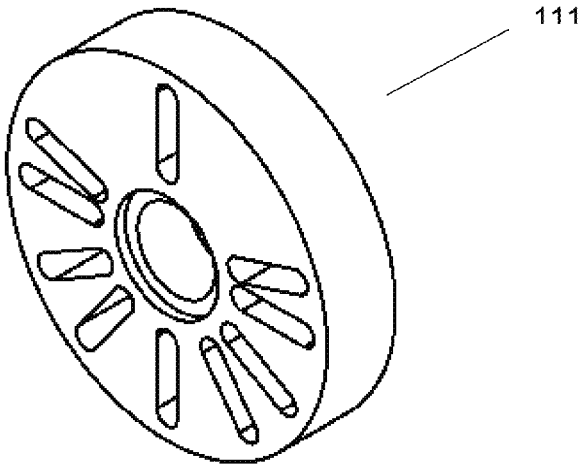

The flange configuration (111) is also specific and is illustrated in isolation in FIGS. 4 and 5. As shown in figures, said flange (111) has a central hole for attachment in the machine, and a set of oblong holes radial, which are arranged in three sequences from a reference hole (I, II, III), as illustrated in FIG. 4. from this reference hole (I, II, III) are arranged following a first radial elongated holes (I) spaced at 72°; a second sequence of radial elongated holes (II) spaced at 90; and a third sequence of radial elongated holes (III) spaced at 120°. Said flange (111) has a preferred dimension in the range of 210 mm diameter, and the slots having a width of 13.50 mm width and length between the centers 40 to 42 mm range, however other dimensions descaracterizando not fall within the scope of the object of the present patent application. This configuration of holes in the flange (111) allows a universality of the equipment for the fixation of different wheels, with 3, 4, 5 and 6 holes and of different configurations of drillings, simply adjusting the fastening elements (screws) along the holes of the flange.

The operation of the wheel straightening device occurs as follows: the operator positions and secures the wheel to the flange (111) of the wheel, the end of the main column (110) then checks which wheel points to be corrected, using the measuring rod (116) as the operator manually rotates the wheel, the end of the measuring rod (116) locks at points that are higher and does not touch the points and is low, so the operator can mark the points to be demeaned. The next step is to position the tip of the piston rod (130) hydraulic, the mark made previously, pumping the hydraulic pump (117), and continue applying force to the wheel geometry is fixed, then releases the pressure, and the process is repeated for the following marks. By doing this it is possible to meet the largest number of wheels available in the market, and perform wheel correction quickly without generating wheel twisting problems.

Said equipment can provide varying dimensions, including its flange (111), as well as varied geometric support format (114), but within this same inventive concept and within the scope proposed in this report. In this way, such variations should not be understood as a de-characterization of the object presented and described in this document.

The invention claimed is:

1. A WHEEL STRAIGHTENER DEVICE, comprising:

a main column (110);

a flange (111) mounted on an end of the main column (110) for fixing a wheel;

a measuring rod (116) mounted on the same end of the main column (110) and arranged above the flange (111);

a guide (118) mounted on the same end of the main column (110), a single piece body (115) being movably mounted on the guide (118), and a bearing (114) mounted on a top end of the single piece body (115), the bearing (114) having a geometric shape matching with a shape of an inner region of the wheel for supporting the wheel, wherein the single piece body (115) moves along the guide (118) to approach or move away from the wheel positioned on the flange (111);

a tubular extension (113) formed on a central portion of the main column (110) and perpendicular to the main column (110);

a second tubular extension (120), portion of which is inserted into an end portion of the tubular extension (113) and perpendicular to the main column (110);

a tubular piece (121) mounted on an end of the second tubular extension (120) and being perpendicular to the second tubular extension (120);

a third tube segment (132) being movably inserted into the tubular piece (121) and being parallel to the main column (110);

a piston hydraulic means (130) being mounted on an upper end of the third tube segment (132) and connected to a hydraulic pump (117), which is mounted on the main column (110), by means of hoses (119);

wherein the flange (111) has a central bore, and a plurality of radial oblong holes for matching with drill pattern of the wheel, wherein the plurality of radial oblong holes includes three sets of radial oblong holes, a first set of radial oblong holes (I) includes radial oblong holes (I) spaced evenly with 72° between each pair of adjacent radial oblong holes (I) starting from a reference hole (I, II, III), a second set of radial oblong holes (II) includes radial oblong holes (II) spaced evenly with 90° between each pair of adjacent radial oblong holes (II) starting from the reference hole (I, II, III), and a third set of radial oblong holes (III) includes radial oblong holes (III) spaced evenly with 120° between each pair of adjacent radial oblong holes (III) starting from the reference hole (I, II, III), thus the radial oblong holes of the three sets of radial oblong holes are positioned alternately on the flange (111).

2. The WHEEL STRAIGHTENER DEVICE according to claim 1, wherein the third tube segment (132) have a plurality of holes (131) on one side, where pins are inserted.

3. The WHEEL STRAIGHTENER DEVICE according to claim 1, wherein the piston hydraulic means (130) is pivotably mounted on an upper end of the third tube segment (132).

4. The WHEEL STRAIGHTENER DEVICE according to claim 1, wherein the bearing (114) and the single piece body (115) are separate parts and engaged with each other.

5. The WHEEL STRAIGHTENER DEVICE according to claim 1, wherein a height of the single piece body (115) is adjustable.

6. The WHEEL STRAIGHTENER DEVICE according to claim 5, wherein the height of the single piece body (115) is adjusted by means of a spindle.

7. The WHEEL STRAIGHTENER DEVICE according to claim 5, wherein the height of the single piece body (115) is adjusted by means of a hinged arm.

8. The WHEEL STRAIGHTENER DEVICE according to claim 1, wherein the body (115) and the guide (118) are fixed together by spindle arranged in the body (115).

9. The WHEEL STRAIGHTENER DEVICE according to claim 1, wherein the body (115) and the guide (118) are fixed together through pins and holes disposed in a base of the body (115) and the guide (118).

10. The WHEEL STRAIGHTENER DEVICE according to claim 1, wherein hydraulic pump (117) is mounted on a central region on one side of the main column (110).

11. The WHEEL STRAIGHTENER DEVICE according to claim 1, wherein the bearing (114) is of flat shape.

12. The WHEEL STRAIGHTENER DEVICE according to claim 1, wherein the bearing (114) is of concave shape.

13. The WHEEL STRAIGHTENER DEVICE according to claim 1, wherein the bearing (114) is shaped with a chamfered recess.

14. The WHEEL STRAIGHTENER DEVICE according to claim 1, wherein the flange (111) is in the 210 mm diameter range, and the oblong holes having a width of 13.50 mm and an in-center length in the range from 40 to 42 mm.

* * * * *